US007204734B2

(12) United States Patent
Kawasaki

(10) Patent No.: US 7,204,734 B2
(45) Date of Patent: Apr. 17, 2007

(54) SURFING BOARD LEASH TANGLE PREVENTION INSTRUMENT

(75) Inventor: Masahide Kawasaki, Osaka (JP)

(73) Assignee: Maneuverline, Inc., Osaka-shi (JP)

( * ) Notice: Subject to any disclaimer, the term of this patent is extended or adjusted under 35 U.S.C. 154(b) by 0 days.

(21) Appl. No.: 11/299,943

(22) Filed: Dec. 13, 2005

(65) Prior Publication Data

US 2006/0141879 A1 Jun. 29, 2006

(30) Foreign Application Priority Data

Dec. 28, 2004 (JP) ..... 2004-379424
Feb. 9, 2005 (JP) ..... 2005-032427
Sep. 12, 2005 (JP) ..... 2005-263146

(51) Int. Cl.
*B63B 1/00* (2006.01)

(52) U.S. Cl. ..... 441/75

(58) Field of Classification Search ..... 441/75; 43/43.1, 44.89, 44.91, 44.92
See application file for complete search history.

(56) References Cited

U.S. PATENT DOCUMENTS 3,120,715 A * 2/1964 Long ..... 43/43.1
4,938,725 A * 7/1990 Beck ..... 441/75
5,194,026 A * 3/1993 Corwin et al. ..... 441/75
5,685,751 A * 11/1997 Feyas ..... 441/75
5,901,495 A * 5/1999 Leigeber ..... 43/44.92
6,942,532 B2 * 9/2005 Snyder ..... 441/75

FOREIGN PATENT DOCUMENTS

JP 63-43576 3/1988

* cited by examiner

*Primary Examiner*—Lars A. Olson
(74) *Attorney, Agent, or Firm*—Armstrong, Kratz, Quintos, Hanson & Brooks, LLP.

(57) ABSTRACT

The present invention provides a surfing board leash tangle prevention instrument which prevents a leash on a surfing board from being stepped on, without being a hindrance or large resistance when on the move in the water. The leash for linking the surfing board to a user is attached with a weight member for sinking the leash into the sea or water. In order to make the weight member movable in the longitudinal direction of the leash, the weight member comprises a ring member having a through-hole which is larger than the external diameter of the leash.

17 Claims, 14 Drawing Sheets

SURFING BOARD LEASH TANGLE PREVENTION INSTRUMENT

BACKGROUND OF THE INVENTION

1. Field of the Invention

The present invention relates to a surfing board leash tangle prevention instrument for keeping a wrist or ankle of a user linked to a surfing board so that the surfing board is not swept far away when the user is thrown out into the water from the surfing board during riding on the surfing board. The surfing board includes various boards such as a surfboard and a body board that are used in the ocean or a lake.

2. Description of the Related Art

A surfing board leash is generally made of polyurethane or is a cord (rope) made by twisting thin and long plant fibers together. It is extremely difficult to use a leash of such material, because it floats on the sea level (water level) without sinking into the sea (water) promptly according to the gravity, thus this slack, floating leash winds around a wrist, ankle, or a fin provided on the board. It should be noted that FIG. 24 shows a situation in which an ankle is entangled in a leash 3.

Therefore, a floating body for stretching a leash towards the sea level (water level) side is attached to the leash to constantly stretch the leash towards the sea level (water level) side, whereby the leash is applied with tension towards the sea level (water level) and the tangle is prevented by eliminating the slack of the leash (See, for example, Laid-Open Japanese Utility Model Publication No. Sho 63-43576).

According to Laid-Open Japanese Utility Model Publication No. Sho 63-43576, since the floating body is at the sea level (water level), the leash between the floating body and the surfing board floats in the vicinity of the sea level, thus an ankle or-wrist of the user is entangled in the leash. Moreover, depending on the position of the floating body, the floating body becomes a hindrance to the user, and the floating leash comes on the upper surface of the surfing board, thereby causing the user to step on the leash.

Further, when the surfing board moves, the floating body also becomes large resistance to the movement of the surfing board, thus it is extremely difficult to use such leash.

In view of such circumstances described above, the present invention tries to solve the problems by providing a surfing board leash tangle prevention instrument that does not become a hindrance to a user, prevents stepping on a leash that is on a surfing board, and does not become large resistance to the movement of the surfing board.

SUMMARY OF THE INVENTION

In order to solve the above-described problems, in the surfing board leash tangle prevention instrument of the present invention, a leash for linking the surfing board to a user is attached with a weight member for allowing the leash to sink into the sea or water.

By providing the weight member for allowing the leash to sink into the sea or water as described above, the leash does not become present not only on the upper surface of the surfing board but also at or in the vicinity of the sea level (water level) around the surfing board, thus the leash can be positioned under the sea (water) at all times. Moreover, even if a wrist or ankle that is fastened to the leash submerges in the sea (water), the weight of the weight member causes the leash to move downward as much as the wrist or ankle submerges in the sea, whereby the wrist or ankle can be securely prevented from being entangled in the leash in the sea (water).

The weight member may be configured from a ring member which has a through-hole larger than the external diameter of the leash in order to allow the weight member to be movable in the longitudinal direction of the leash.

At least one end of both ends of the leash may be provided with a taper portion whose external diameter becomes larger toward an end portion thereof, and the size of the through-hole of the weight member may be set so that a section forming the through-hole of the weight member is embedded in an intermediate portion of the taper portion to make the weight member unmovable.

The ring member may be configured by a metallic ring main body which is in the form of a circle and ring, and by a cover body made of synthetic resin for covering an outer surface of the ring main body, excluding at least an inner peripheral surface that contacts with the leash.

The weight member attached externally to the leash may be configured so that the cross-sectional shape thereof, which is obtained by cutting the weight member lengthwise along the leash, forms substantially a circular arc or triangle.

The surfing board leash tangle prevention instrument may be configured such that a leash for linking a surfing board to a user is provided removably with a weight member for holding the leash in a direction substantially perpendicular to the longitudinal direction of the leash and for sinking the leash into the sea or water, that the weight member is configured to be substantially "C" shaped so as to release both ends thereof freely, and that the weight member is provided with locking and holding means for allowing the weight member to hold the leash in a direction substantially perpendicular to the longitudinal direction of the leash from the released ends of the weight member and for holding the leash in the state where the released ends are closed.

By providing the weight member for allowing the leash to sink into the sea or water as described above, the leash does not become present not only on the upper surface of the surfing board but also at or in the vicinity of the sea level (water level) around the surfing board, thus the leash can be positioned under the sea (water) at all times. Moreover, even if a wrist or ankle that is fastened to the leash submerges in the sea (water), the weight of the weight member causes the leash to move downward as much as the wrist or ankle submerges in the sea, whereby the wrist or ankle can be securely prevented from being entangled in the leash in the sea (water).

Furthermore, since the weight member is provided with the locking and holding means, the weight member attached to the leash can be removed easily and promptly from the direction substantially perpendicular to the longitudinal direction of the leash by simply performing lock cancellation operation, whereby cleaning, checking, and replacement of the weight member can be performed.

The surfing board leash tangle prevention instrument may be configured such that a weight member, which is attached to a leash for linking a surfing board to a user, and which sinks the leash into the sea or water is provided, the weight member is configured with a metallic coil member which spirally winds around the leash at a predetermined pitch so as to have a curvature radius which is the same as or slightly larger than the radius of the leash, and the leash is locked to one end of the weight member to spin the leash, thereby the weight member is engaged with the leash.

By providing the weight member for allowing the leash to sink into the sea or water as described above, the leash does not become present not only on the upper surface of the surfing board but also at or in the vicinity of the sea level (water level) around the surfing board, thus the leash can be positioned under the sea (water) at all times. Moreover, even if a wrist or ankle that is fastened to the leash submerges in the sea (water), the weight of the weight member causes the leash to move downward as much as the wrist or ankle submerges in the sea, whereby the wrist or ankle can be securely prevented from being entangled in the leash in the sea (water).

Further; by configuring the weight member with the simple coil member, the present invention becomes advantageous in terms of the production cost, and the coil member can be attached promptly to the leash simply by locking the leash to one end of the coil member and spinning the leash. In the case of a weight member which is freely opened and closed, an object may contact with the weight member, whereby the weight member is accidentally brought to the opened state and then removed from the leash. However, in the case of the coil member, the weight member is not removed from the leash even when an object contacts with the weight member. By applying, for example, soft synthetic resin or foamable synthetic resin (urethane or the like) on the surface (outer surface) of the coil member, the board can be prevented from being damaged by contacting with the coil member, and protection against rust is also provided.

An end portion of the leash on the user side may be provided with a taper portion whose external diameter becomes larger toward an end portion thereof, and a spiral groove portion with which a part of the coil member in the longitudinal direction is engaged, may be formed on the taper portion.

By providing the weight member for allowing the leash to sink into the sea or water, the leash does not become present not only on the upper surface of the surfing board but also at or in the vicinity of the sea level (water level) around the surfing board, thus the leash can be positioned under the sea (water) at all times. Stepping on the leash on the upper surface of the surfing board, which occurs in the prior art, is prevented, and the leash that floats in the periphery of the surfing board does not become a hindrance by winding around a writs or ankle. Moreover, even if a wrist or ankle that is fastened to the leash submerges in the sea (water), the weight of the weight member causes the leash to move downward as much as the wrist or ankle submerges in the sea, whereby the wrist or ankle can be securely prevented from being entangled in the leash in the sea (water), and the surfing board leash tangle prevention instrument, which is easy to use, can be provided. Furthermore, the present invention can be made advantageous in terms of its usage, because the weight member does not become large resistance to the movement of the surfing board when the surfing board moves, while the floating body is the large resistance.

Since the weight member is made movable in the longitudinal direction of the leash, by configuring the weight member with the ring member having the through-hole which is larger than the external diameter of the leash, the weight member can move in the longitudinal direction of the leash as the user moves. Therefore, the present invention is easy to handle without causing a large burden on the user by applying the weight of the weight member and the weight of the leash at once, when, for example, the weight member is fixed to the leash.

At least one end of both ends of the leash may be provided with the taper portion whose external diameter becomes larger toward the end portion thereof, and the size of the through-hole of the weight member is set so that a section (inner section) forming the through-hole of the weight member is embedded in an intermediate portion of the taper portion to make the weight member unmovable. Accordingly, the weight member can be embedded in and fixed to the end of the leash when the leash is not used. Particularly, when the leash is used in shoal patches, the weight member can be embedded in and fixed to the taper portion at the user side end portion of the leash, whereby the weight member can be positioned and held firmly to the taper portion at the user side end portion of the leash, appearing out of the sea. Therefore, the coil member of the weight member can be prevented from being caught by complex rocks and corals at the bottom of the sea.

The weight member is configured by a metallic ring main body which is in the form of a circle and ring, and by a cover body made of synthetic resin for covering an outer surface of the ring main body, excluding at least an inner peripheral surface that contacts with the leash, whereby the weight member easily moves on the metallic inner peripheral surface of the ring main body in which the resistance to sliding movement is small, and, by covering the outer surface of the ring main body with the cover body made of synthetic resin, surface treatment of the ring main body does not have to be performed. Therefore, the present invention is advantageous in terms of the production cost.

In the case in which the weight member attached externally to the leash is configured so that the cross sectional shape thereof, which is obtained by cutting the weight member lengthwise along the leash, forms substantially a circular arc or triangle, by using the surfing board in a state in which the apex of the circular arc or triangle faces the direction of water current, the resistance of the weight member to the movement of the surfing board can be made extremely small.

Moreover, in the case in which the weight member comprises the locking and holding means, the weight member attached to the leash can be removed easily and promptly from the direction substantially perpendicular to the longitudinal direction of the leash by simply performing lock cancellation operation, whereby cleaning, checking, and replacement of the weight member can be performed, thus improved marketability can be obtained.

By configuring the weight member with the simple coil member, the present invention becomes advantageous in terms of the production cost, and the coil member can be attached promptly to the leash simply by locking the leash to one end of the coil member and spinning the leash, thus the present invention also becomes advantageous in terms of the cost and its usage. Furthermore, for example, in the case of a weight member which is freely opened and closed, an object in the sea may contact with the weight member, whereby the weight member is accidentally brought to the opened state and then removed from the leash. However, in the case of the coil member, the weight member is not removed from the leash even when an object contacts with the weight member, whereby high reliability is obtained. By applying a coating of, for example, soft synthetic resin or foamable synthetic resin (urethane or the like) on the surface (outer surface) of the coil member, the board can be prevented from being damaged by contacting with the coil member, and protection against rust is also provided. Therefore, the surfing board can be used in a good condition for an extended period.

An end portion of the leash on the user side is provided with a taper portion whose external diameter becomes larger toward an end portion thereof, and a spiral groove portion with which a part of the coil member in the longitudinal direction is engaged, is formed on the taper portion. Accordingly, when the leash is used in shoal patches, the coil member is engaged with the spiral groove portion on the end portion side, whereby the coil member can be positioned and held firmly to the user side end portion of the leash, appearing out of the sea. Therefore, the coil member of the weight member can be prevented from being caught by complex rocks and corals at the bottom of the sea. Moreover, the user side end portion of the leash can be stretched straight by the coil member, thus an ankle can be prevented from being entangled in the user side end portion of the leash which is rolled.

DESCRIPTION OF THE PREFERRED EMBODIMENTS

Figure 1:
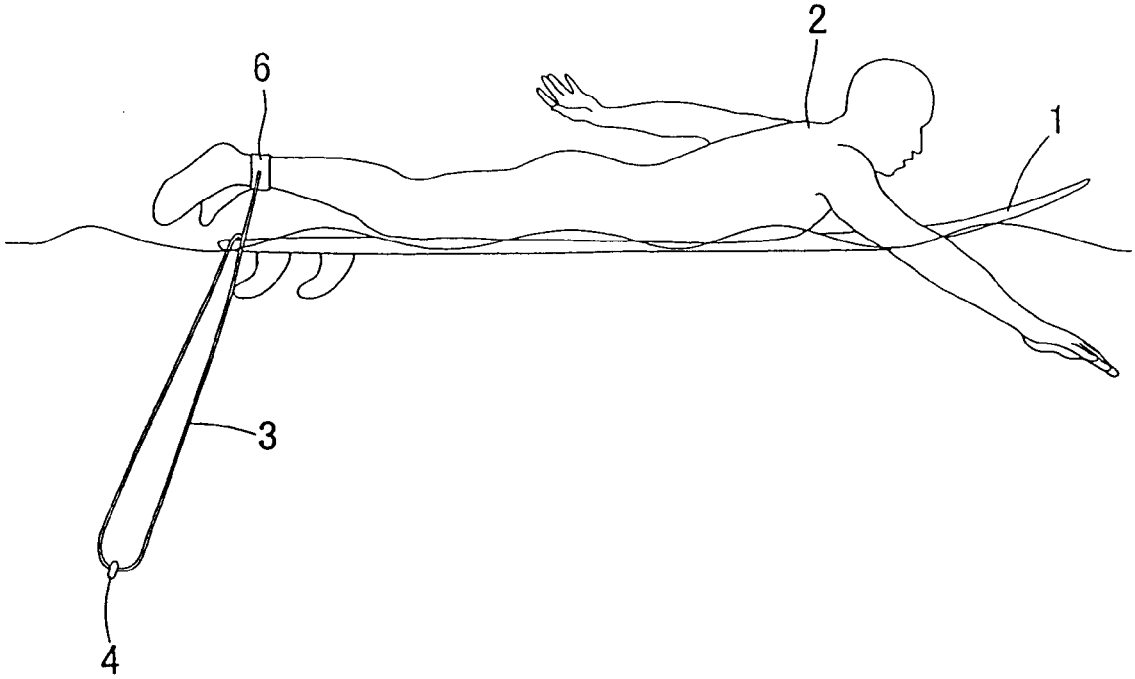
FIG. 1 is a side view showing an image of surfing in a state in which the user is linked to the surfing board with a leash tangle prevention instrument which comprises a first weight member.

As shown in FIG. 1, the surfing board leash tangle prevention instrument is configured by linking an ankle (or knee) of a user 2 who surfs face-down on a surfboard 1, which is an example of the surfing board, to a rear end portion of the surfboard 1 by means of a leash (also called "cord") 3, and attaching a weight member 4 for sinking the leash 3 in the sea (water) to the leash 3. The surfing board may be other board such as a body board. The position of linking the user 2 to the surfing board may be a position other than the one shown in FIG. 1. By providing the weight member 4, the leash 3 can be caused to sink in the sea (water), whereby the leash 3 can be prevented from being positioned on the upper surface of the surfing board 1 and floating in the periphery of the surfing board 1. Furthermore, the leash 3 that is placed on the surfing board 1 can be prevented from being stepped on, and the ankle or a wrist can be securely prevented from being entangled in the leash 3 that floats in the vicinity of the surfing board 1.

The leash 3 is made of urethane, and the cross-sectional shape thereof is in the form of a circle so as to be floatable on the surface of water. Therefore, the leash 3 is constantly caused to sink under the sea by being attached to the weight member 4 so that the ankle or wrist of the user 2 is not entangled in the leash 3. Besides various synthetic resins to create the leash 3, the leash 3 may be a string (rope) obtained by twisting thin and long plant fibers.

Figure 2:
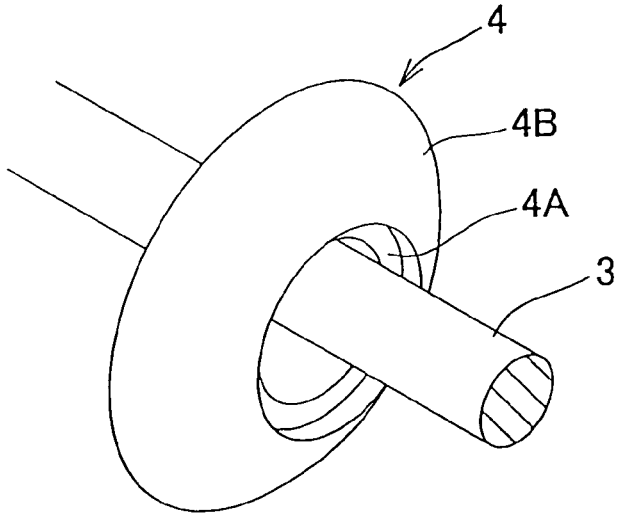
FIG. 2 is a perspective view of the first weight member.
Figure 3:
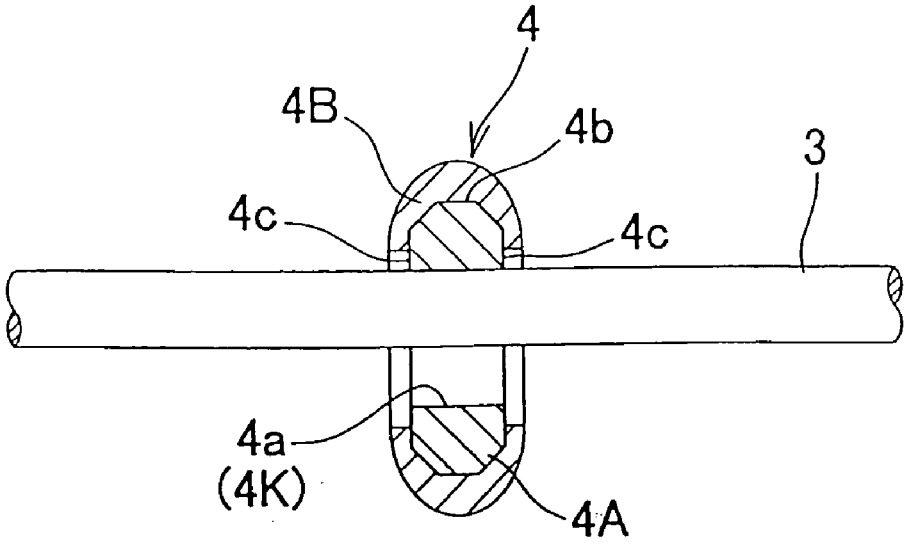
FIG. 3 is a longitudinal side view of the first weight member.
Figure 4:
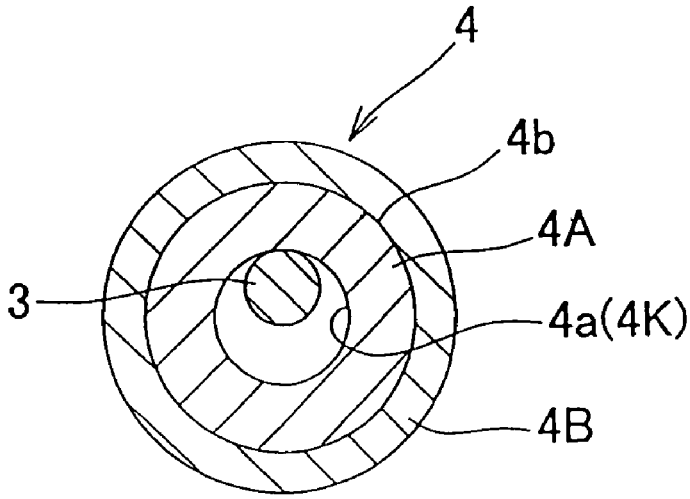
FIG. 4 is a longitudinal plane view of the first weight member.

The weight member 4 is configured as shown in FIG. 2 through FIG. 4. Specifically, in order to allow the weight member 4 to be movable in the longitudinal direction of the leash 3, the weight member 4 is configured with a ring member that has a through-hole 4K which is larger than the external diameter of the leash 3 (1.2 times or more (preferably 1.5 times or more) larger than the external diameter of the leash 3), and this ring member is configured with a circle and ring-shaped metallic ring main body 4A and a cover body 4B made of synthetic resin which covers an outer surface of the ring main body 4A excluding at least an inner peripheral surface 4*a* contacting with the leash 3, that is, an area between a position which is close to an outer peripheral surface 4*b* by a predetermined distance and the outer peripheral surface 4*b* on a side surface 4*c* between the inner surface 4*a* and outer peripheral surface 4*b*. In this manner, since the cover body 4B made of synthetic resin does not cover the inner peripheral surface 4*a* and a part of the side surface 4*c* near the inner peripheral surface 4*a*, the area at which the weight member contacts with the leash 3 can be made small. Therefore, the present invention has an advantage that the weight member 4 can move smoothly with respect to the leash 3. However, both side faces 4*c*, 4*c* that are not covered may be covered by the cover body 4B made of synthetic resin. As a material used in the ring main body 4A, it is advantageous to, use aluminum which hardly generates rust so that surface treatment does not have to be performed, but other metallic material may be used by applying a coating agent on the surface.

Figure 5:
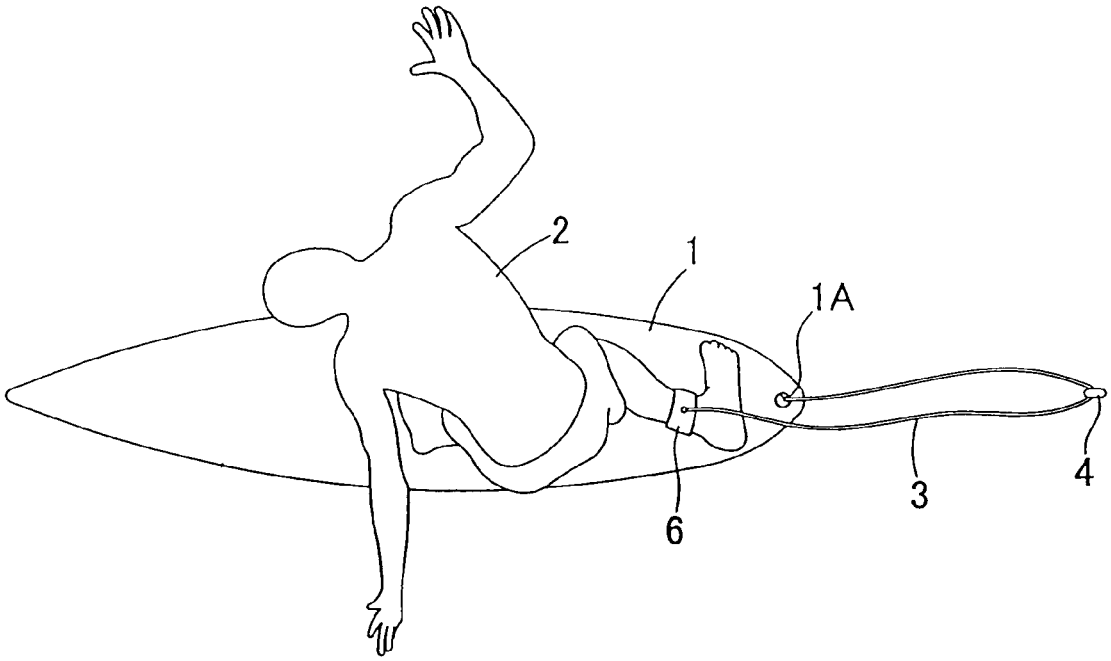
FIG. 5 is a plane view showing an image of surfing in a state in which the standing user is linked to the surfing board with the leash tangle prevention instrument.
Figure 6:
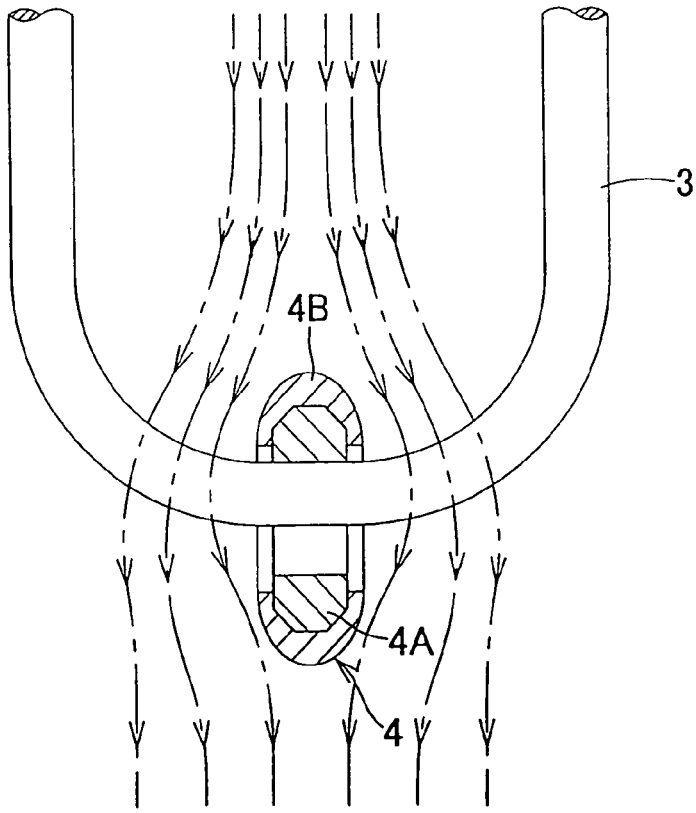
FIG. 6 is a cross-sectional plane view showing the relationship between the leash tangle prevention instrument shown in FIG. 1 and water current.

In the state in which the surfing board is used as shown in FIG. 5, as shown in FIG. 6 as well, the weight member 4 is configured so that the cross-sectional shape thereof, which is obtained by cutting the weight member lengthwise along the leash 3, forms a circular arc (or substantially triangle (shape of a mountain)). Accordingly, by using the surfing board in a state in which the apex of the circular arc or triangle faces the direction of water current, there is an advantage that the resistance of the weight member 4 to the movement of the surfing board can be made extremely small.

Figure 7:
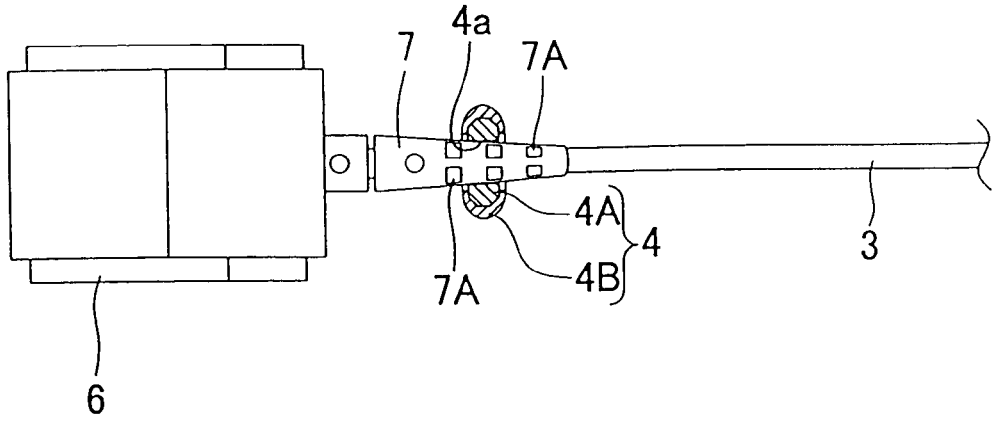
FIG. 7 is a plane view showing a configuration of a user side end portion of a leash.
Figure 8:
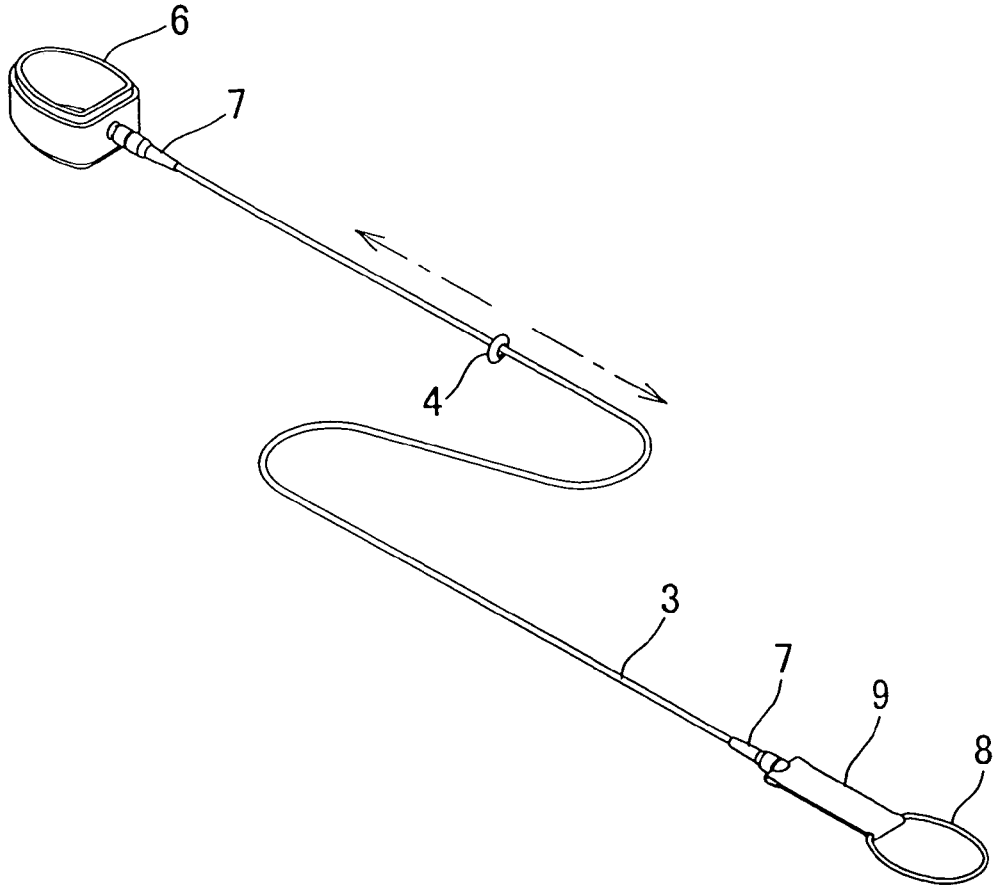
FIG. 8 is a perspective view of the leash tangle prevention instrument shown in FIG. 1.

As shown in FIG. 7 and FIG. 8, a fastening member 6 fastening the user to the leash 3 and a holding member 9 holding a string 8 that is connected to a through-hole 1A of the surfboard 1, are rotatably connected to respective ends of the leash 3. A member 7 in the form of a rough cone that configures a taper portion whose external diameter becomes larger toward an end portion thereof is externally attached to an end portion on the fastening member 6 side of the leash 3 and an end portion on the holding member 9 side, and the size of the through-hole of the weight member 4 is set so that a section(inner section, that is each end portion of the inner peripheral surface 4*a*) forming the through-hole of the weight member 4 is embedded in an intermediate portion (substantially a center portion in the longitudinal direction of the member 7 in the figure) of the member 7 to make the weight member 4 unmovable. Therefore, by fixing the weight member 4 to either one of the members 7, when the leash is used in, for example, shoal patches the weight member 4 is pulled out of the sea so that the weight member 4 is prevented from being caught by complex rocks and corals at the bottom of the sea. Further, the weight member 4 can be fixed to either one of the members 7 configuring the taper portion. 7A shown in FIG. 7 are concave portions that are formed on the surface of the member 7, but the concave portions 7A may not be provided. Here, the member 7 configuring the taper portion is provided in each end of the leash 3, either one of the both ends may be provided with the member 7 configuring the taper portion.

Figure 9:
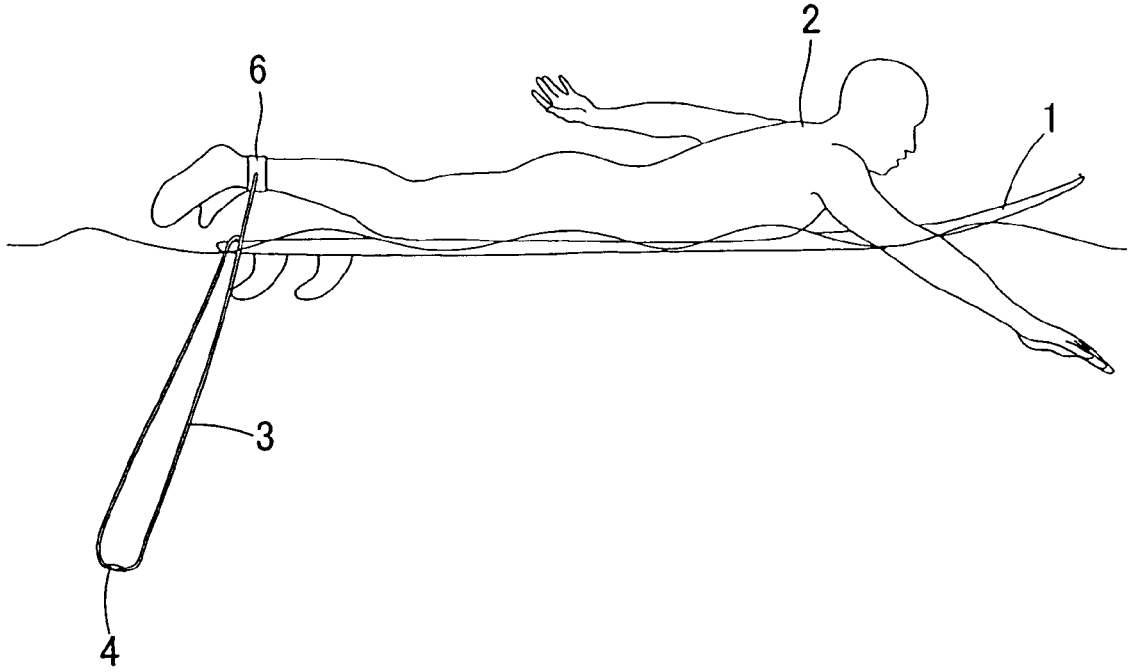
FIG. 9 is a side view showing an image of surfing in a state in which the user is linked to the surfing board with the leash tangle prevention instrument which comprises a second weight member.

Moreover, as shown in FIG. 9, the surfing board leash tangle prevention instrument is configured by linking the ankle (or knee) of the user 2 who surfs face-down on the surfboard 1, which is an example of the surfing board, to the rear end portion of the surfboard 1 by means of the leash (also called "cord") 3, and by removably attaching the weight member 4 for sinking the leash 3 in the sea (water) to the leash 3. The surfing board may be other board such as a body board. The position of linking the user 2 to the surfing board may be a position other than the one shown in FIG. 9. By providing the weight member 4, the leash 3 can be caused to sink in the sea (water), whereby the leash 3 can be prevented from being positioned on the upper surface of the surfing board 1 and floating in the periphery of the surfing board 1. Furthermore, the leash 3 that is placed on the surfing board 1 can be prevented from being stepped on, and the ankle or a wrist can be securely prevented from being; entangled in the leash 3 that floats in the vicinity of the surfing board 1.

The leash 3 is made of urethane, and the cross-sectional shape thereof is in the form of a circle so as to be floatable on the surface of water. Therefore, the leash 3 is constantly caused to sink under the sea by being attached to the weight member 4 so that the ankle or wrist of the user 2 is not entangled in the leash 3. Besides various synthetic resins to create the leash 3, the leash 3 may be a string (rope) obtained by twisting thin and long plant fibers.

Figure 10:
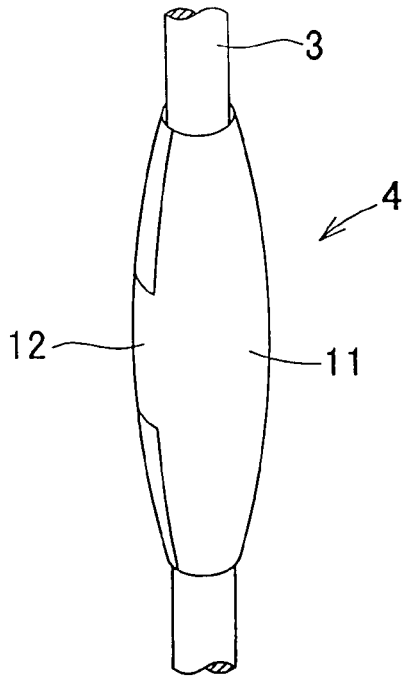
FIG. 10 is a perspective view of the second-weight member.
Figure 11:
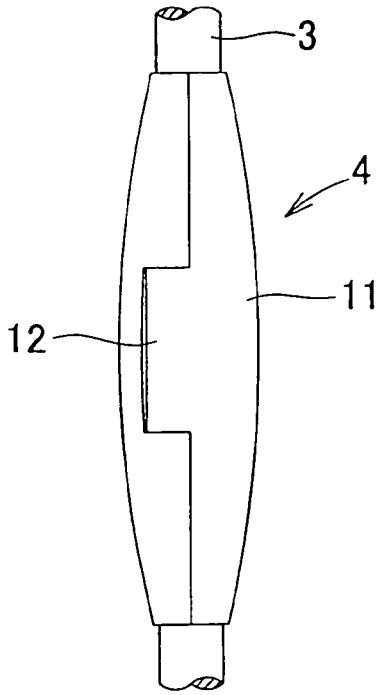
FIG. 11 is a side view of the second weight member.
Figure 12:
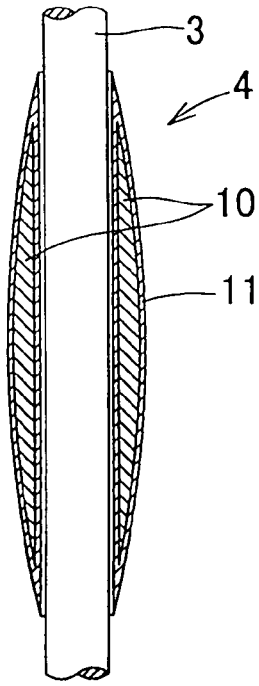
FIG. 12 is a longitudinal side view of the second weight member.
Figure 13:
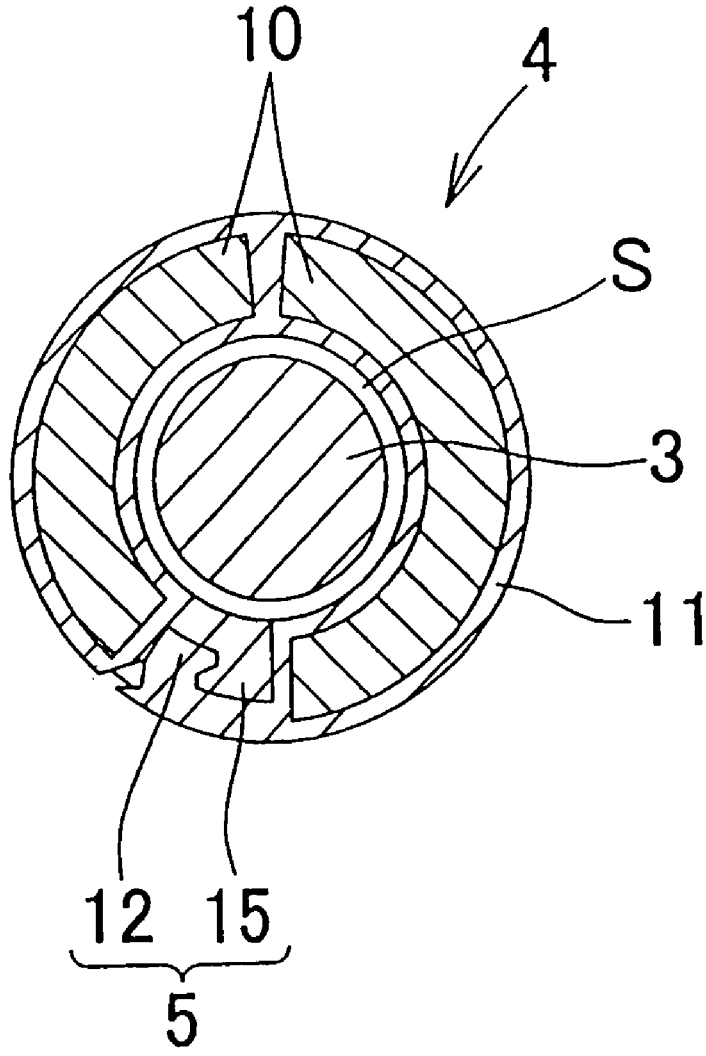
FIG. 13 is a longitudinal side view showing a state in which the second weight member is attached to the leash.
Figure 14:
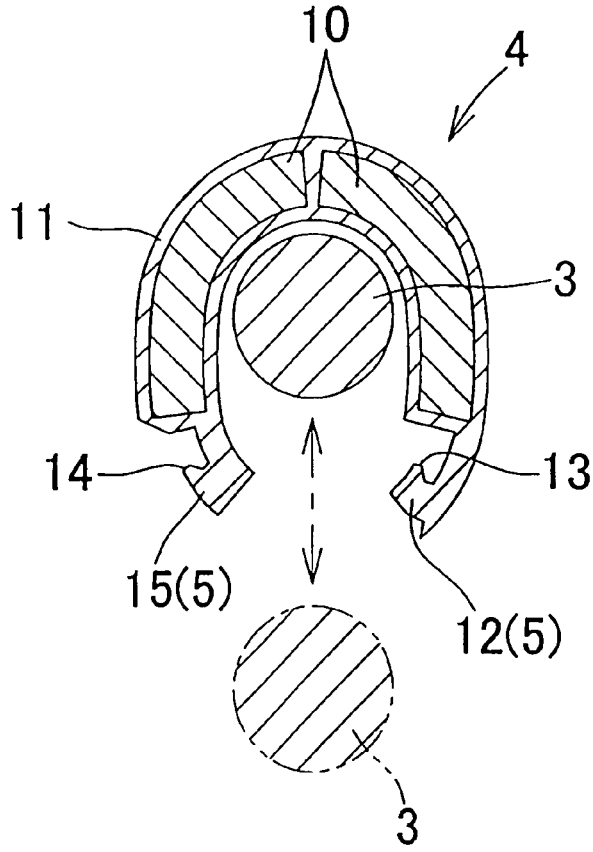
FIG. 14 is a longitudinal side view showing a state immediately before attaching the second weight member to the leash.

The weight member 4 is configured as shown in FIG. 10 through FIG. 14. Specifically, as shown in FIG. 14, the weight member 4 is a member, whose cross-sectional shape is in the form of a rough character "C" in the opened state in which both ends thereof are released, and which is cylindrical and vertically long along the longitudinal direction of the leash 3 in the closed state as shown in FIG. 10 and FIG. 11. The weight member is formed so as to have a shape which tapers toward the both ends in the longitudinal direction thereof, in other words a shape of a circular arc that forms a gentle arc to have a large curvature radius from one end toward the other end in the longitudinal direction.

The weight member 4 comprises two weights 10, 10 disposed in a circumferential direction, and a cover member 11 that covers the weights 10, 10. Locking and holding means 5 for locking and holding both released ends of the weight member 4 in the closed state is configured by a first locking portion 12 which is extended in the circumferential direction to an external section of the both released ends at a substantially central portion in the longitudinal direction of the cover 11, that is the direction along the longitudinal direction of the attached leash 3, and by a second locking portion 15 which has a nib portion 14 engaged with a nib portion 13 formed in the first locking portion 12 to lock and hold the weight member, and which is extended in the circumferential direction to an internal section of the other released end. By providing the locking portions 12, 15 on the both released ends as described above, the locking portions 12, 15 are prevented from protruding from the outer surface of the weight member 4 to the outside when the ends are closed, as shown in FIG. 10 and FIG. 11, whereby the locking portions 12, 15 do not become resistance to the movement of the surfing board in the sea (water). Preferably the weights 10 are made of heavy metal such as lead, copper, or iron with a specific gravity of 4 or above so as to allow the leash 3 to securely sink in the sea (water), while the volume of the weights is small. As shown in FIG. 13, a gap S is created between the inner surface of the weight member 4 and the outer surface of the leash 3 so that the weight member 4 can move with respect to the leash 3, but the gap S may not be necessary. Here, the inner surface of the weight member 4 and the outer surface of the leash 3 may be fixed to each other completely by means of two-sided tape.

When attaching the weight member 4 having the above configuration to the leash 3, first, the weight member 4 whose ends are released is caused to hold the leash 3 from the direction perpendicular to the longitudinal direction of the leash by means of the released ends (see FIG. 14). From this state, the locking members 12, 15 are drawn to cause the nib portions 13, 14 to be locked and held with each other, thereby holding the leash by closing the released ends (see FIG. 13). Then, the user 2 is linked to the surfing board 1 by means of the leash 3 to which the weight member 4 is attached, and the instrument can be used as shown in FIG. 9. By configuring the weight 4 to have a vertically long shape whose external diameter is slightly larger than the eternal diameter of the leash 3, when the surfboard is moved in the sea (water) it is possible to prevent the weight 4 from being large resistance to the movement of the surfing board as much as possible.

Figure 15:
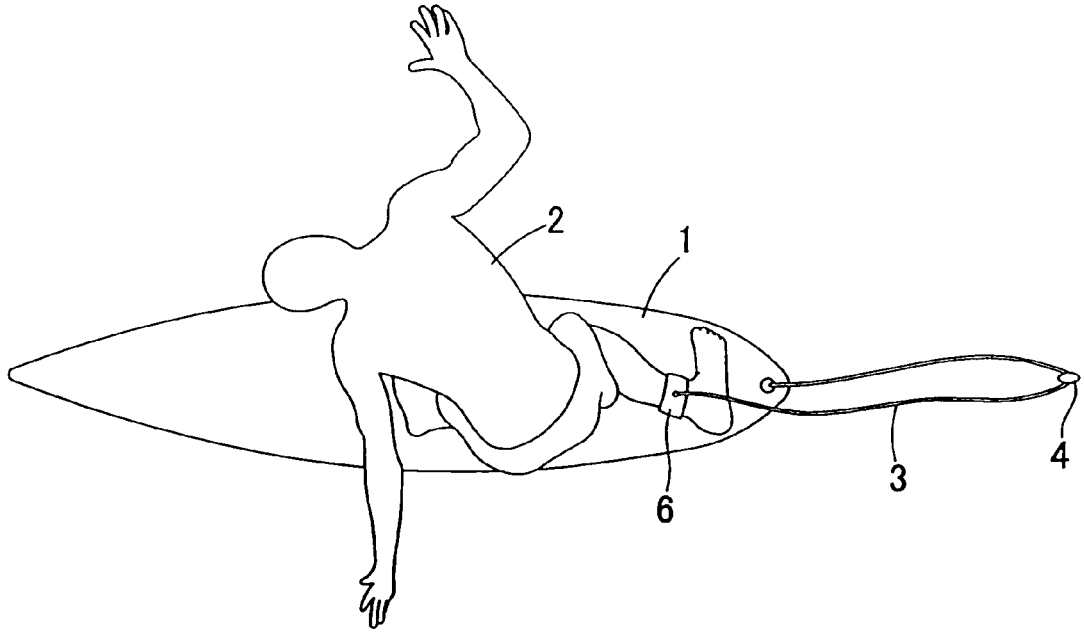
FIG. 15 is a plane view showing an image of surfing in a state in which the user is linked to the surfing board with the leash tangle prevention instrument which comprises a third weight member.
Figure 16:
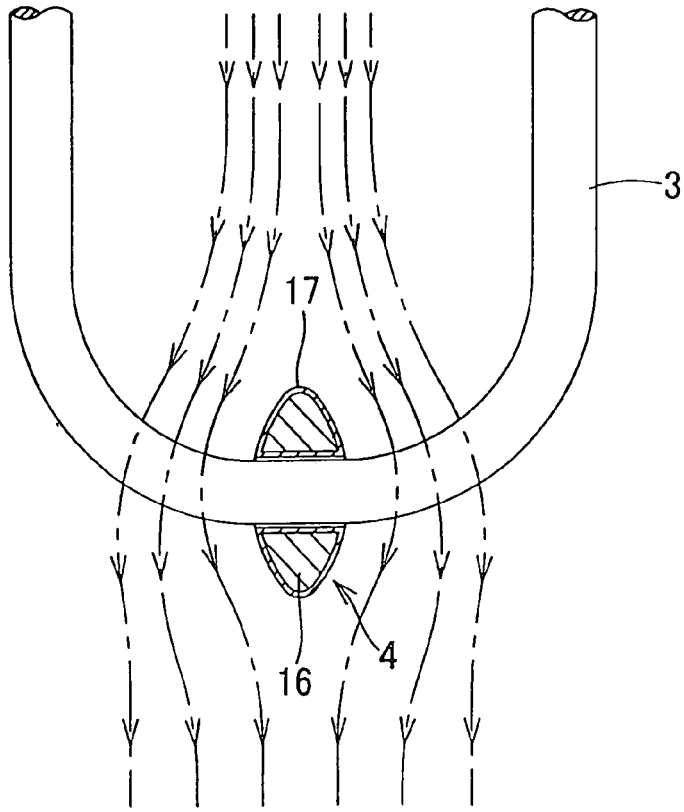
FIG. 16 is a cross-sectional plane view showing the relationship between the leash tangle prevention instrument shown in FIG. 15 and water current.
Figure 17:
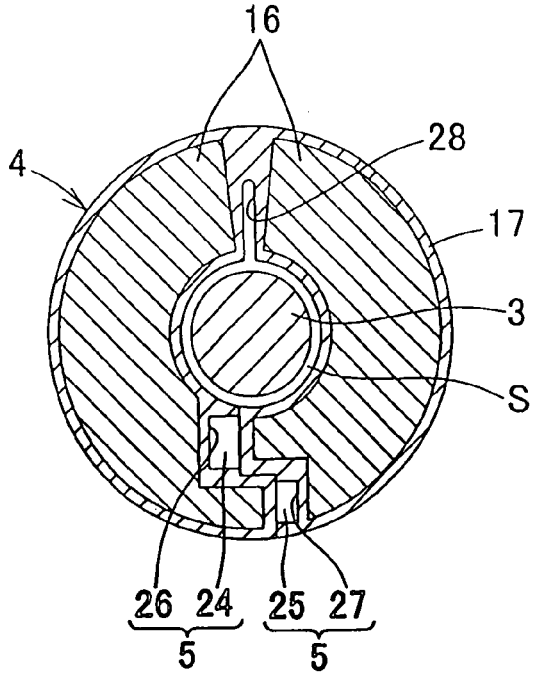
FIG. 17 is a longitudinal side view showing a state in which the third weight member is attached to the leash.

The weight member 4 may be configured as shown in FIG. 15 through FIG. 18. Specifically, as shown in FIG. 16, the weight 4 is configured so that the cross-sectional shape thereof, which is obtained by cutting the weight member lengthwise along the leash 3 when being attached to the leash 3, forms substantially triangle (shape of a mountain), and the apex portion of the triangle is caused to face the direction of water current as shown in FIG. 16 when using the surfing board, whereby there is an advantage that the resistance of the weight member 4 to the movement of the surfing board can be made extremely small. Moreover, the weight member 4 is provided with the locking and holding means 5 for allowing the weight member 4 to hold the leash 3 from the released ends of the weight member 4 to the leash 3 in the direction substantially perpendicular to the longitudinal of the leash 3, and holding the leash in the form of a donut by closing the released ends. As shown in FIG. 17, the gap S is created between the inner surface of the weight member 4 and the outer surface of the leash 3 so that the weight member 4 can move with respect to the leash 3, but the gap S may not be necessary. Here, the inner surface of the weight member 4 and the outer surface of the leash 3 may be fixed to each other completely by means of two-sided tape.

Figure 18:
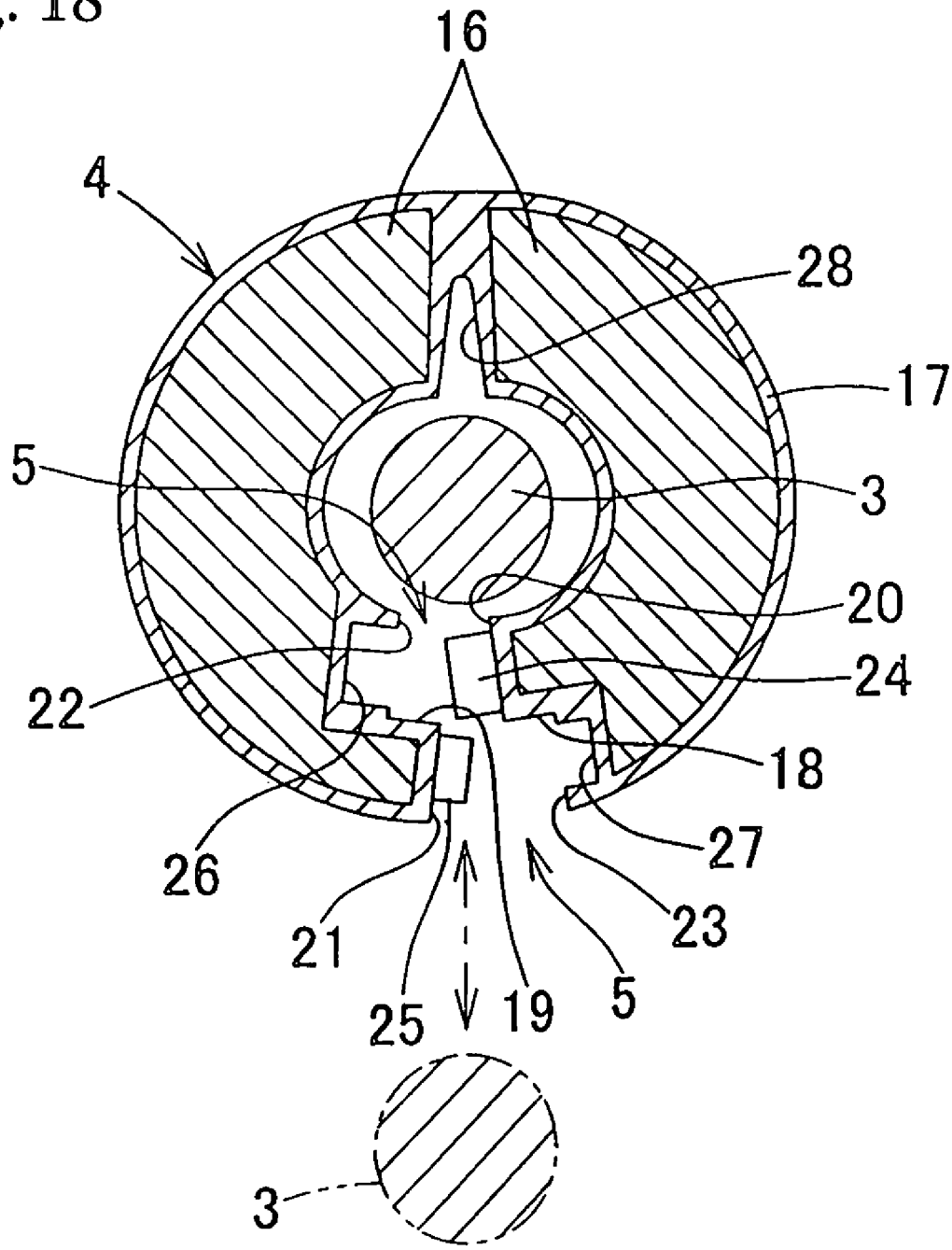
FIG. 18 is a longitudinal side view showing a state immediately before attaching the third weight member to the leash.

To describe the weight member 4 in detail, as shown in FIG. 17 and FIG. 18 the weight member 4 is configured with two metallic weights 16, 16 and a cover 17 made of synthetic resin which covers outer surfaces of the weights 16, 16. Both end faces of the cover 17 have end faces 20, 21 or 22, 23 at two different sections in a circumferential direction, with a step portion 18 or 19 therebetween. A convex portion 24 or 25 that protrude in a circumferential direction is provided on either one of the end faces 20 and 21 of the end faces 20, 22 or 21, 23 that abut against each other. There is provided a concave portion 26 or 27 which is concaved on the other end face 22 or 23 in the circumferential direction and in which the convex portion 24 or 25 is embedded so that it can be locked. As shown in FIG. 18, there is configured the locking and holding means 5 for allowing the weight member 4 to hold the leash 3 from the released ends of the weight member 4 in the direction substantially perpendicular to the longitudinal direction of the leash 3 to fix two pairs of convex portions 24, 25 and concave portions 26, 27 by locking them with each other when closing the released ends (see FIG. 17). Here, the two pairs of convex portions 24, 25 and concave portions 26, 27 configuring the locking and holding means 5 are provided, and the position for locking the two pairs of convex portions and concave portions is located in different positions in the circumferential direction, but it may be located in the same position in the circumferential direction. Moreover, in FIG. 18, one end face of the cover 17 has two end faces 20, 23 at different positions in the circumferential direction, with the step portion 18 therebetween, the convex portion 24 is provided on the end face 20 of the two end faces 20, 23, and the concave portion 27 is provided on the other end face 23, and the concave portion 26 and the convex portion 25 on the other end of the cover 17 that are locked with these convex and concave portions are provided respectively on the two end faces 22, 21 that are formed in different positions in the circumferential direction, with the step portion 19 therebetween. However, other configuration may be applied. 28 shown in FIG. 17 and FIG. 18 is a vertically long concave groove which is concaved on the substantially central portion of the C-shaped weight member 4 from the inner surface side to the outer surface side of the weight member 4, and extends in the longitudinal direction of the leash 3. The thickness of the substantially central portion of the weight member 4 is made thinner so that the opening operation of the weight member 4 can be performed with a small control force, but the concave groove 28 may not be necessary.

When attaching the weight member 4 shown in FIG. 16 through FIG. 18 to the leash 3, both ends of the weight member 4 are released, and then the weight member 4 is caused to hold the leash 3 from the direction perpendicular to the longitudinal direction of the leash 3 by inserting the leash 3 through the released ends (see FIG. 18). Next, by closing the both ends, the two pairs of convex portions 24, 25 and concave portions 26, 27 can be locked with each other to hold the weight member 4 in the shape of a ring as shown in FIG. 17. At this time, the gap S is created between the inner surface of the weight member 4 and the outer surface of the leash 3 so that the weight member 4 can move with respect to the leash 3. After completing the attachment, in the state in which the surfing board 1 is used as shown in FIG. 15, the apex portion of the triangle obtained by cutting the weight member lengthwise along the leash 3 is caused to face the direction of water current, which is shown with arrows as shown in FIG. 16, whereby the resistance of the weight member 4 to the movement of the surfing board can be made extremely small.

Figure 19:
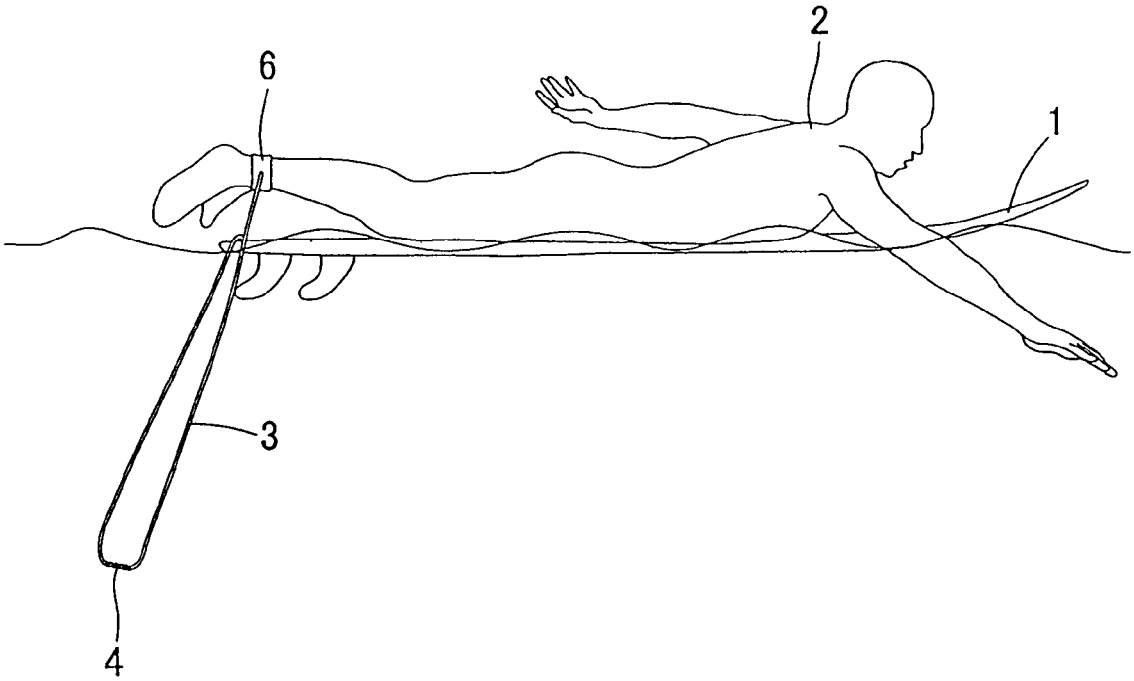
FIG. 19 is a plane view showing an image of surfing in a state in which the user is linked to the surfing board with the leash tangle prevention instrument which comprises a fourth weight member.
Figure 20:
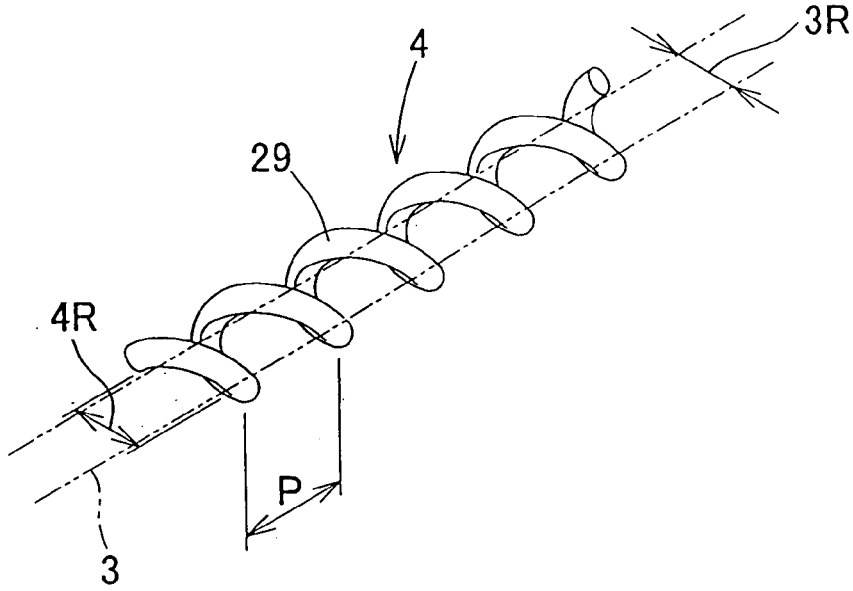
FIG. 20 is a perspective view of the fourth weight member.
Figure 21:
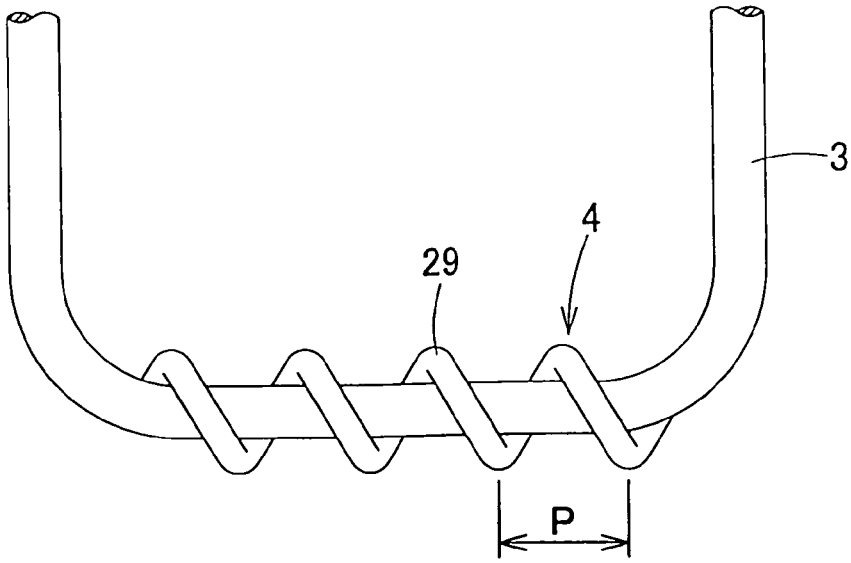
FIG. 21 is a plane view showing a state in which the fourth weight member is attached to the leash.

The weight member 4 may be configured as shown in FIG. 19 through 21. Specifically, as shown in FIG. 20, the weight member 4 is configured with a metallic coil member 29 which spirally winds around the leash 3 at a predetermined pitch P so as to have ½ (half) of a curvature radius 4R which is slightly larger than ½ (half) of the radius 3R of the leash 3, whereby the coil member 29 can easily move with respect to the leash 3 by its own weight. When the coil member 29 moves to the side away from the leg in the sea (water) (side where the water depth becomes deeper), the leg can be further prevented from being entangled in the leash 3. However, the coil member 29 may be caused to spirally wind around the leash 3 so as to have a curvature radius which is the same as ½ (half) of the radius 3R of the leash 3 to stop the coil member 29 to easily move with respect to the leash 3 by its weight. The cross-sectional shape of the coil member 29 is round, but it may be an oblong shape or have angles. Moreover, by providing the pitch (gap) P, there is an advantage that the coil member 29 can be easily made attachable and detachable with respect to the leash 3. The size of the pitch P can be changed in accordance with the thickness of the leash 3, but attachment and detachment of the coil member 29 with respect to the leash 3 is easy if the pitch P is made larger than the thickness (diameter) of the leash 3. When attaching the coil member 29 to the leash 3, one end of the coil member 29 is engaged with the leash 3 first, and then the leash 3 is turned along the spiral of the coil member 29, whereby the leash 3 can be positioned in the coil member 29 to complete the attachment. Furthermore, since the coil member 29 is formed into a spiral, and is not fixed in a specific position of the leash 3, thus there is an advantage that the coil member 29 does not become resistance to the sea (water). A coating of soft synthetic resin or foamable synthetic resin may be applied on the surface (outer surface) of the coil member 29 so that the board can be prevented from being damaged by contacting with the coil member 29. The application of soft synthetic resin or foamable synthetic resin also provides protection against rust. The material of the coil member 29 is configured from the ones described above, but by changing the length of the coil member 29, the weight of the weights can be adjusted easily.

Figure 22:
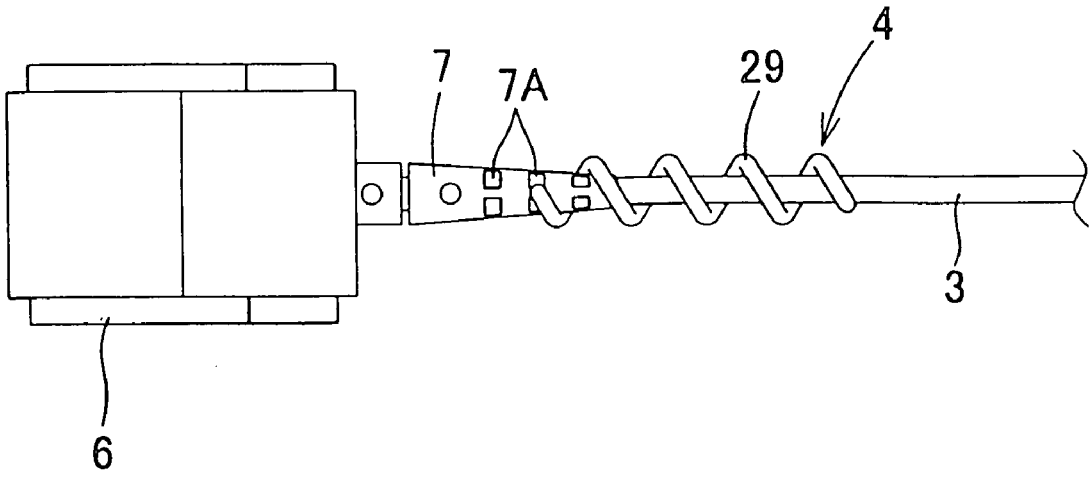
FIG. 22 is a plane view showing a configuration of the user side end portion of the leash.

As shown in FIG. 22, the fastening member 6 for fastening the user to the leash 3 is rotatably connected to the user side end portion of the leash 3. By externally attaching the conical member 7, which configures the taper portion whose external diameter becomes larger toward the end portion thereof, to an end portion of the leash 3 on the fastening member side, and one end of the coil member 29 is externally attached to (pushed against) the member 7, whereby the coil member 29 is fixed to the member 7. Accordingly, when the leash is used in shoal patches the coil member 29 is pulled out of the sea so that the coil member 29 is prevented from being caught by complex rocks and corals at the bottom of the sea. Moreover, the user side end portion of the leash 3 can be stretched straight by the coil member 29, thus the ankle can be prevented from being entangled in the user side end portion of the leash 3 which is rolled. 7A shown in FIG. 22 are concave portions that are formed on the surface of the member 7. There is an advantage that the coil member 29 is securely prevented from being moved to the side opposite of the user end portion of the leash 3 by the tip end of the coil member 29 being embedded in the concave portion 7A. However, the concave portions 7A may not be necessary.

Figure 23:
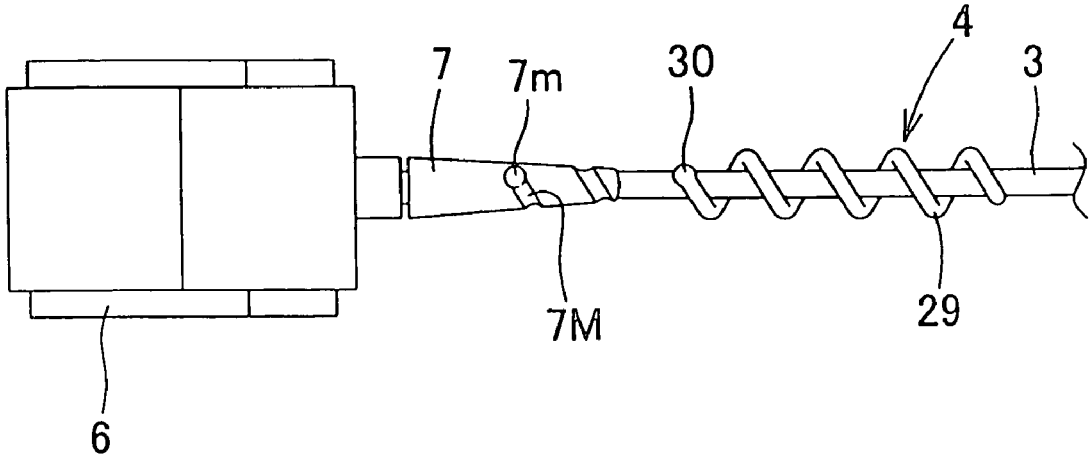
FIG. 23 is a plane view in which a groove portion is formed on a taper portion which is provided on the user end portion of the leash.
Figure 24:
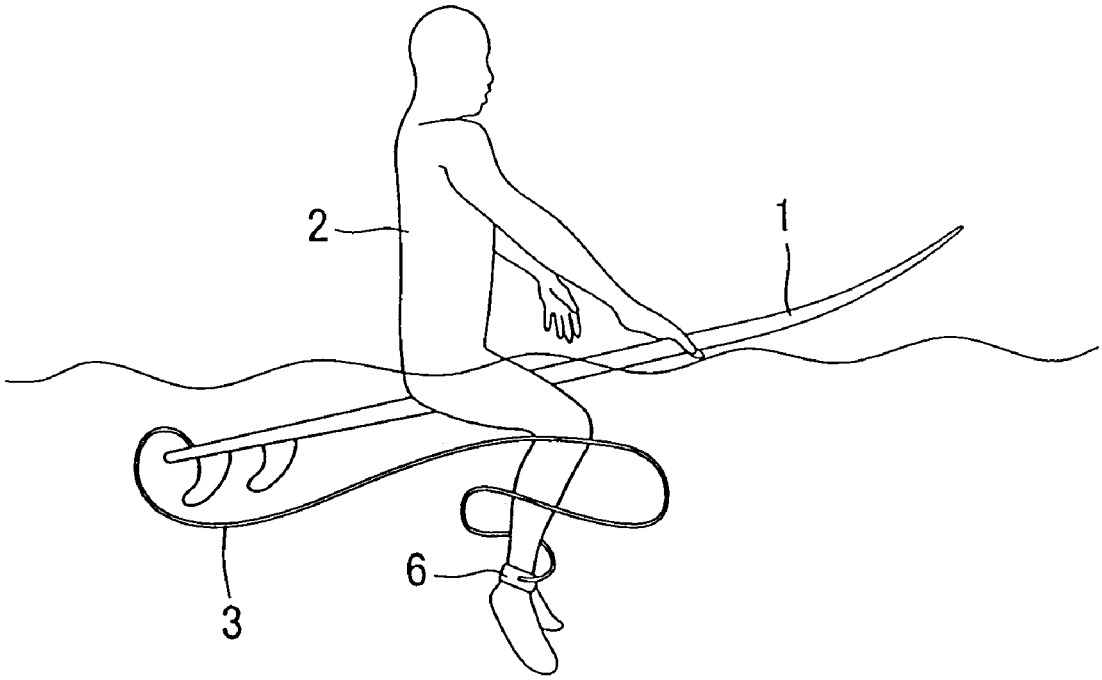
FIG. 24 is an explanatory diagram showing a state in which the leash winds around an ankle of the user.

Moreover, as shown in FIG. 23, by forming a spiral groove portion 7M on the outer surface of the member 7 of the end portion of the leash 3 on the fastening member side, and causing the coil member 29 to be engaged with the spiral groove portion 7M, there is an advantage that the coil member 29 can be positioned and held firmly to the user side end portion of the leash 3 appearing out of the sea. By providing a spherical portion 30 having the diameter larger than the diameter of the coil member 29 on the tip end of the coil member 29, and by forming, on an end portion of the groove 7M on the user side, a concave portion 7*m* (formed to become deeper than the groove portion 7M) in which a part of the spherical portion 30 is embedded in the concave portion 7m to perform locking and holding, there is an advantage that the coil member 29 can be securely prevented from being moved from the groove portion 7M to the side where the coil member 29 is removed (board side which is opposite from the user side). However, these components may not be necessary.

What is claimed is:

1. A surfing board leash tangle prevention instrument comprising:

a leash for linking a surfing board to a user; the leash being attached with a weight member; and the weight member being movably attached to the leash, wherein the weight member is movable in a longitudinal direction of the leash, and the weight member allows the leash to sink into the sea or water.

2. A surfing board leash tangle prevention instrument comprising:

a leash for linking a surfing board to a user; the leash being attached to a weight member; and, the weight member being a ring member which has a through-hole larger than the external diameter of the leash in order to allow the weight member to be movable in a longitudinal direction of the leash, wherein the weight member allows the leash to sink into the sea or water.

3. The surfing board leash tangle prevention instrument according to claim 2, wherein at least one end of both ends of the leash is provided with a taper portion whose external diameter becomes larger toward an end portion thereof, and the size of the through-hole of the weight member is set so that a section forming the through-hole of the weight member is embedded in an intermediate portion of the taper portion to make the weight member unmovable.

4. The surfing board leash tangle prevention instrument according to claim 3, wherein the ring member comprises a metallic ring main body which is in the form of a circle and a ring, and a cover body made of synthetic resin for covering an outer surface of the ring main body, excluding at least an inner peripheral surface that contacts with the leash.

5. The surfing board leash tangle prevention instrument according to claim 4, wherein the weight member attached externally to the leash is configured so that the cross-sectional shape thereof, which is obtained by cutting the weight member lengthwise along the leash, forms substantially a circular arc or triangle.

6. The surfing board leash tangle prevention instrument according to claim 3, wherein the weight member attached externally to the leash is configured so that the cross-sectional shape thereof, which is obtained by cutting the weight member lengthwise along the leash, forms substantially a circular arc or triangle.

7. The surfing board leash tangle prevention instrument according to claim 2, wherein the ring member comprises a metallic ring main body which is in the form of a circle or a ring, and a cover body made of synthetic resin for covering an outer surface of the ring main body, excluding at least an inner peripheral surface that contacts with the leash.

8. The surfing board leash tangle prevention instrument according to claim 7, wherein the weight member attached externally to the leash is configured so that the cross-sectional shape thereof, which is obtained by cutting the weight member lengthwise along the leash, forms substantially a circular arc or triangle.

9. The surfing board leash tangle prevention instrument according to claim 2, wherein the weight member attached externally to the leash is configured so that the cross-sectional shape thereof, which is obtained by cutting the weight member lengthwise along the leash, forms substantially a circular arc or triangle.

10. The surfing board leash tangle prevention instrument according to claim 2, wherein at least one end of both ends of the leash is provided with a taper portion whose external diameter becomes larger toward an end portion thereof, and the size of the through-hole of the weight member is set so that a section forming the through-hole of the weight member is embedded in an intermediate portion of the taper portion to make the weight member unmovable.

11. The surfing board leash tangle prevention instrument according to claim 10, wherein the ring member comprises a metallic ring main body which is in the form of a circle or a ring, and a cover body made of synthetic resin for covering an outer surface of the ring main body, excluding at least an inner peripheral surface that contacts with the leash.

12. The surfing board leash tangle prevention instrument according to claim 11, wherein the weight member attached externally to the leash is configured so that the cross-sectional shape thereof, which is obtained by cutting the weight member lengthwise along the leash, forms substantially a circular arc or triangle.

13. The surfing board leash tangle prevention instrument according to claim 10, wherein the weight member attached externally to the leash is configured so that the cross-sectional shape thereof, which is obtained by cutting the weight member lengthwise along the leash, forms substantially a circular arc or triangle.

14. The surfing board leash tangle prevention instrument according to claim 2, wherein the weight member attached externally to the leash is configured so that the cross-sectional shape thereof, which is obtained by cutting the weight member lengthwise along the leash, forms substantially a circular arc or triangle.

15. A surfing board leash tangle prevention instrument, wherein a leash for linking a surfing board to a user is provided removably with a weight member for holding the leash in a direction substantially perpendicular to the longitudinal direction of the leash and for sinking the leash into the sea or water, the weight member is configured to be substantially "C" shaped so as to release both ends thereof freely, and the weight member is provided with locking and holding means for allowing the weight member to hold the leash in a direction substantially perpendicular to the longitudinal direction of the leash from the released ends of the weight member and for holding the leash in a state where the released ends are closed.

16. A surfing board leash tangle prevention instrument, wherein a weight member, which is attached to a leash for linking a surfing board to a user, and which sinks the leash into the sea or water is provided, the weight member is configured with a metallic coil member which spirally winds around the leash at a predetermined pitch so as to have a curvature radius which is the same as or slightly larger than the radius of the leash, and the leash is locked to one end of the weight member and turned, thereby attaching the weight member to the leash.

17. The surfing board leash tangle prevention instrument according to claim 16, wherein an end portion of the leash on the user side is provided with a taper portion whose external diameter becomes larger toward an end portion thereof, and a spiral groove portion with which a part of the coil member in the longitudinal direction is engaged is formed on the taper portion.

* * * * *